United States Patent [19]

Meliga

[11] Patent Number: 4,653,301

[45] Date of Patent: Mar. 31, 1987

[54] BENDING MACHINE FOR PIPES, SECTIONS AND SIMILAR

[76] Inventor: Mauro Meliga, Viale Roma 26, 10052 Bardonecchia, Italy

[21] Appl. No.: 780,387

[22] Filed: Sep. 26, 1985

[30] Foreign Application Priority Data

Oct. 2, 1984 [IT] Italy ..... 53880/84[U]

[51] Int. Cl.[4] ..... B21D 5/12; B21D 5/06

[52] U.S. Cl. ..... 72/175; 72/174; 72/170

[58] Field of Search ..... 72/173, 174, 170, 168, 72/166, 169, 175, 171, 172

[56] References Cited

U.S. PATENT DOCUMENTS

| | | | |
|---|---|---|---|
| 702,836 | 6/1902 | Weber | 72/168 |
| 928,220 | 7/1909 | Schneider | 72/175 |
| 1,793,351 | 2/1931 | Bell | 72/168 |
| 2,335,028 | 11/1943 | Rose et al. | 72/173 |
| 3,144,071 | 8/1964 | Nash | 72/166 |
| 3,595,052 | 7/1971 | Steck et al. | 72/173 |

FOREIGN PATENT DOCUMENTS

| | | | |
|---|---|---|---|
| 65327 | 11/1892 | Fed. Rep. of Germany | 72/170 |
| 342653 | 9/1904 | France | 72/170 |
| 1379019 | 10/1964 | France | 72/175 |

*Primary Examiner*—Daniel C. Crane

*Attorney, Agent, or Firm*—Kane, Dalsimer, Kane, Sullivan and Kurucz

[57] ABSTRACT

The bending machine comprises two pairs of parallel feed rollers between which the pipe is fed in a given first direction, and a slide moving in a second direction perpendicular to the first and having a pair of bend rollers turning on it in idle manner; each of the said rollers being designed to press against and bend the said pipe subsequent to displacement of the said slide, and means being provided for lowering and clearing one of the said rollers from the said pipe when the other said roller is forced against the same for bending it subsequent to displacement of the said slide.

7 Claims, 6 Drawing Figures

BENDING MACHINE FOR PIPES, SECTIONS AND SIMILAR

BACKGROUND OF THE INVENTION

The present invention relates to a bending machine for pipes, sections and similar, enabling any number of bends to be formed fully automatically, even zigzag bends with very tight bend radii, as required for special applications such as furniture. The machine covered by the present invention is specially designed for accommodating a numerical control unit for controlling the machine according to a given operating routine.

Utility model application No. 53552-B/80, filed on Oct. 3, 1980, relates to a fully-automatic zigzag bending machine essentially comprising two pairs of parallel feed rollers, between which the pipe is fed in a given first direction, and a third pair of bend rollers parallel with the former. The latter rollers are mounted in idle manner on a table turning round an axis lying in the same plane as and at the same distance from the axes of the said third pair of rollers. The said turntable is fitted on a slide travelling in a direction essentially perpendicular to the pipe feed direction.

On the said machine, the pipe is first fed by the said feed rollers through the said third pair of bend rollers, after which, the said slide is shifted in such a manner as to cause one of the said bend rollers to exert sufficient bending force on the pipe, essentially perpendicular to the feed direction. During the latter operation, the table on which the bend rollers are mounted turns round its rotation axis into a position whereby the said plane containing the axes of the two bend rollers is essentially perpendicular to the tangent of the bend pipe axis.

Though the aforementioned machine provides for fully-automatic zigzag bending and the production of fine quality semifinished parts, it does not enable the formation of bends having very tight bend radii. Such are prevented by the position assumed by both the turntable, on which the bend rollers are mounted, and the slide, which causes one of the said two bend rollers to contact one of the said feed rollers. Consequently, the minimum bend radius obtainable on the aforementioned machine is that allowed by the said turntable-slide arrangement.

SUMMARY OF THE INVENTION

The aim of the present invention is to provide a bending machine of the aformentioned type designed to overcome the said drawback, i.e. designed to enable fully-automatic zigzag bends with even very small bend radii.

With this aim in view, the present invention relates to a bending machine for pipes, sections or similar, comprising two pairs of parallel feed rollers between which the pipe is fed in a given first direction, and of which the rollers of at least one of the said pairs are powered; characterised by the fact that it comprises a slide moving in a second direction perpendicular to the first and to the axes of the said rollers, and having a pair of bend rollers turning on it in idle manner; each of the said rollers being designed to press against and bend the said pipe subsequent to displacement of the said slide, and means being provided for lowering and clearing one of the said rollers from the said pipe when the other said roller is forced against the same for bending it subsequent to displacement of the said slide.

The said means comprise a pair of turning blocks housed in an opening on the said slide and hinged on a pin having its axis parallel with the said first direction and being mounted on the said slide in the centre plane of the same; and a fixed supporting member for the said blocks, located beneath the same in such a position as to support one of the said blocks in a position whereby the respective roller axis is parallel with the said feed rollers, while at the same time enabling the other block to be lowered when the said slide is shifted for setting the turning roller on the first block against the pipe for the purpose of bending it.

BRIEF DESCRIPTION OF THE DRAWINGS

The machine according to the present invention will now be described by way of a non-limiting example with reference to the attached drawings in which.

DETAILED DESCRIPTION OF THE INVENTION

Figure 4:
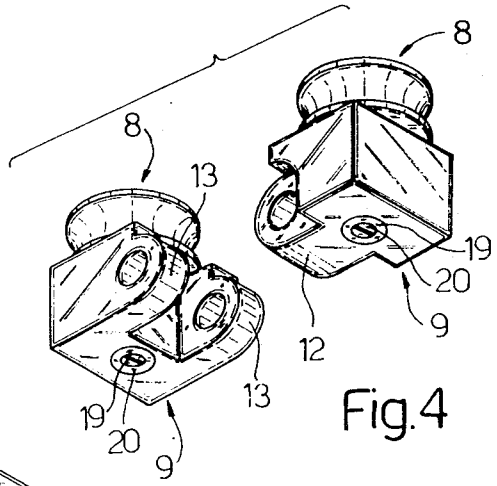
FIG. 4 shows a view in perspective of the blocks and relative turning end rollers on the machine according to the present invention.

As shown in the attached drawings, the bending machine according to the present invention essentially comprises two pairs of parallel feed rollers 1 between which is fed pipe 2 for bending. The said rollers, which are conveniently mounted on a supporting plate 3, present appropriate revolving surfaces 4, designed to mate with part of the outer surface on pipe 2. At least one pair of the said rollers is powered by an appropriate drive facility (not shown).

The machine according to the present invention also comprises a slide 5 designed to travel crosswise in relation to plate 3 and essentially perpendicular to the feed direction of pipe 2 as defined by the pair of feed rollers 1. The said slide is conveniently housed inside an opening 6 in plate 3 across which it is guided by means of rails 7. The said slide is fitted with a pair of idle bend rollers 8, each designed to be forced, as described later on, against the surface of pipe 2 for bending the latter subsequent to displacement of slide 5. The machine according to the present invention also comprises means for lowering and clearing one of rollers 8 from surface of pipe 2 when the other roller, subsequent to displacement of slide 5, is forced against pipe 2 for bending.

The said means comprise a pair of blocks 9, as shown in perspective in FIG. 4, housed inside an opening 10 on slide 5 and hinged on pin 11, the latter having its axis parallel with the pipe feed direction and being mounted on slide 5 essentially in the centre plane of the same.

As shown clearly in FIG. 4, blocks 9 are conveniently parallelepiped, one having a projection 12 designed to fit between a pair of tabs 13 on the other block. In the said projecting member and tabs, holes are formed for accommodating pin 11 and so hinging the said blocks on to slide 5.

The means for lowering either of the said bend rollers 8 also comprise a fixed supporting member 16 designed to support either of the said two blocks 9 as described later on. The said member, which in the arrangement shown is essentially in the form of a cylindrical bar, is located beneath blocks 9 and in such a position as to support one of the said blocks in a position whereby the axis of respective roller 8 is parallel with that of feed rollers 1, while at the same time enabling the other block to be lowered when slide 5 is displaced from its centre position in relation to opening 6. Such an arrangement is shown clearly in FIG. 6.

Figure 5:
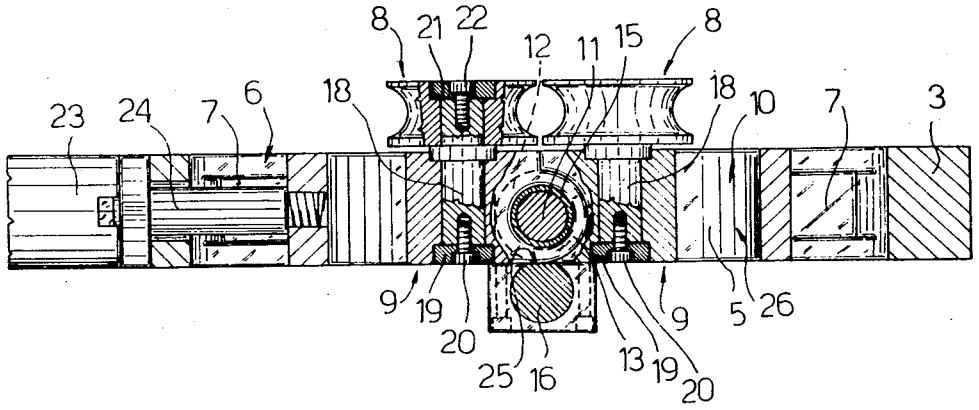
FIGS. 5 and 6 show two machine sections of two different operating positions.

As shown in the FIG. 5 section, each block is conveniently positioned axially on pin 11 by means of a spacer 15, whereas, for mounting respective roller 8, use may be made of pin 18 fitted to the roller itself by means of washer 19 and lock screw 20. Similarly, each roller 8 may be fitted axially on to pin 18 using a further washer 21 locked by corresponding screw 22.

Figure 2:
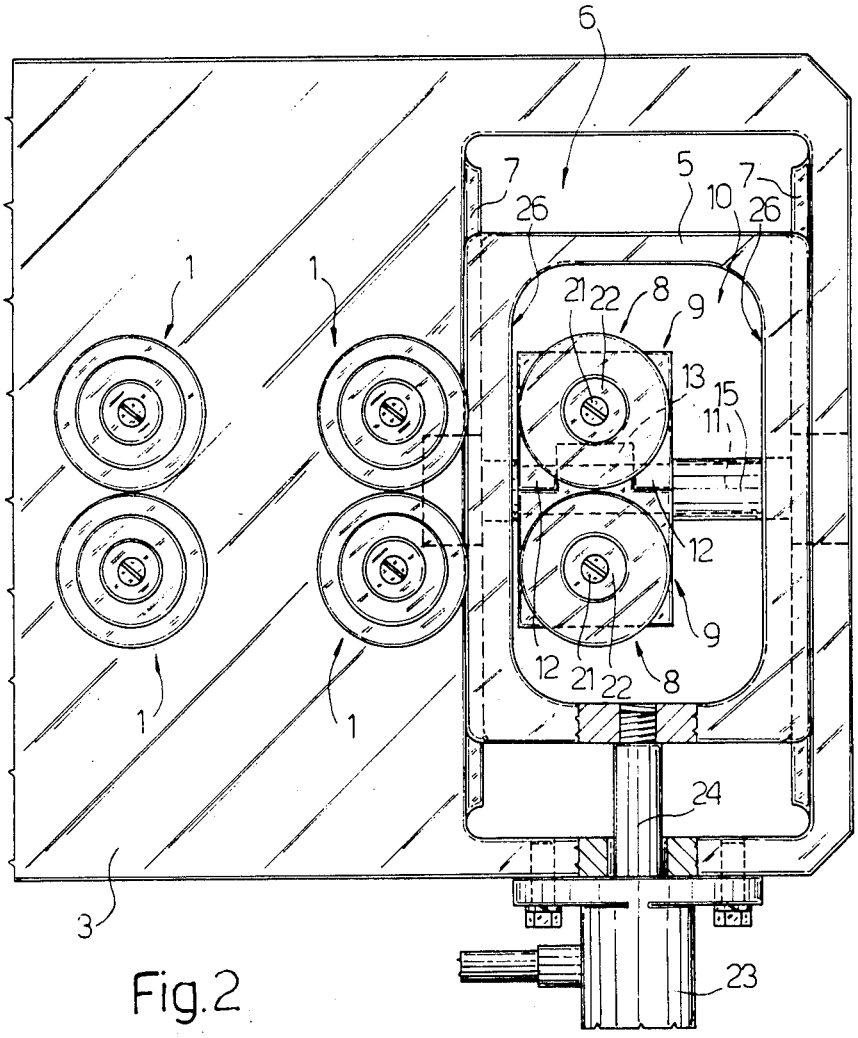
FIG. 2 shows a plan view of the said machine.

As shown clearly in the plan view in FIG. 2, the width of opening 10 on slide 5, measured in the direction of the pin 11 axis, is conveniently, though not necessarily, greater than the width of blocks 9, in such a manner as to allow a certain amount of operating slack on the said blocks inside the said opening and in the pipe feed direction.

Crosswise movement of slide 5 may conveniently be controlled by a hydraulic cylinder 23 fitted on to plate 3 with its rod 24 connected to the slide itself. The said cylinder, which is double-acting for moving slide 5 in both directions, may be controlled by any type of device, e.g. a numerical control.

The bending machine according to the present invention operates as follows.

With the machine in the off position, slide 5 is set essentially in the centre of opening 6, in which position, as shown clearly in FIG. 5, the axis of pin 11 is essentially aligned in the same vertical plane as the axis of supporting member 16. On the top of the latter, provision is conveniently made for a flat surface 25. In such a position, the two blocks 9 are arranged as shown in FIG. 5, with the axes of respective bend rollers 8 essentially vertical and parallel.

For bending the pipe, the latter is placed between feed rollers 1 which feed it through bend rollers 8 positioned as mentioned previously. At this point, hydraulic cylinder 23 is operated for shifting slide 5 crosswise in such a direction as to cause one of bend rollers 8 to exert on the surface of pipe 2 sufficient pressure, perpendicular to the pipe feed direction, for bending the pipe as shown clearly in FIG. 1. Subsequent to displacement of slide 5, the said roller 8 exerting the said pressure on the pipe is maintained with its axis essentially vertical by supporting member 16, which, subsequent to displacement of slide 5, is located beneath respective block 9. The other block, on the other hand, being no longer supported by the said member 16, is allowed to swivel down, in relation to the first block, round respective pin 11, thus causing the respective bend roller 8 to abandon the surface of pipe 2 and to move down with the respective block.

Figure 6:
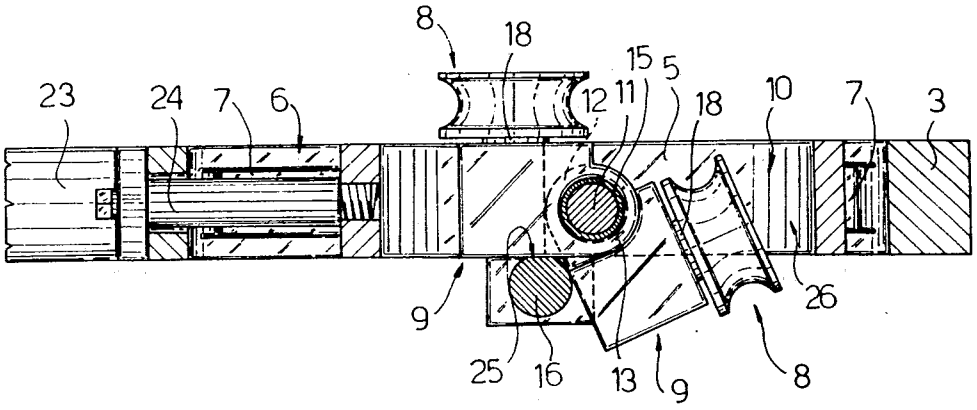

Needless to say, inverting the shift direction of slide 5, for bending pipe 2 the opposite way to that already described, results in an arrangement perfectly symmetrical to that already described and shown in FIG. 6.

Figure 1:
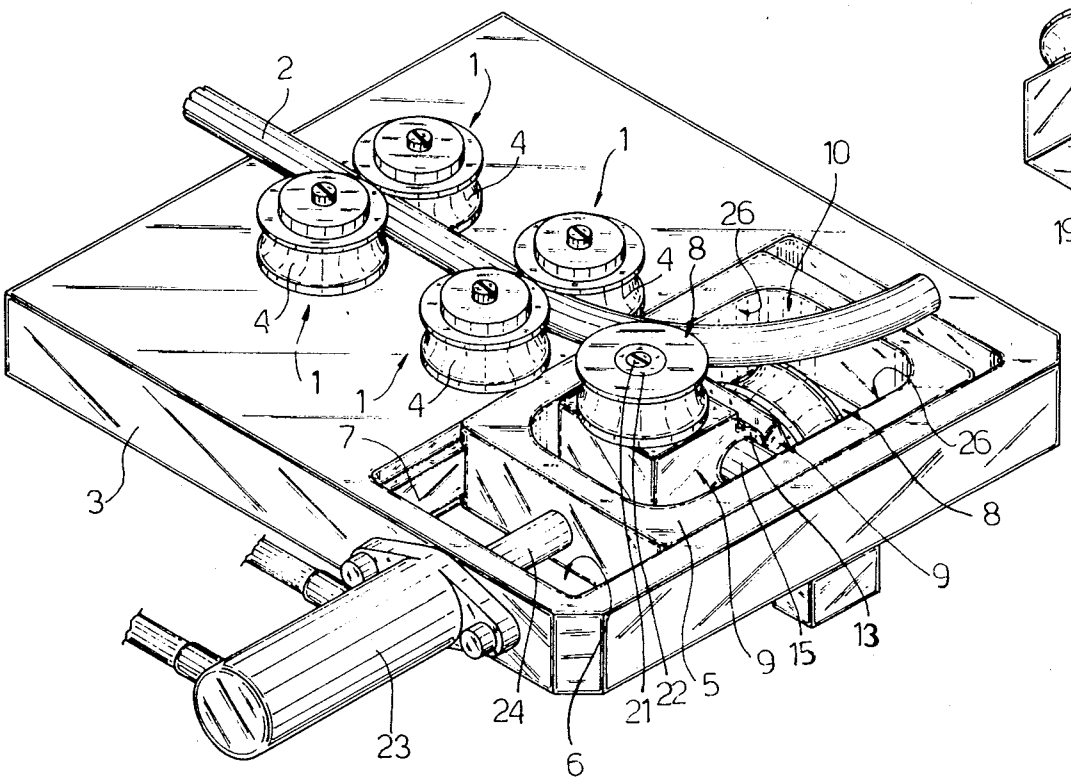
FIG. 1 shows a view in perspective of the basic components on the bending machine according to the present invention.
Figure 3:
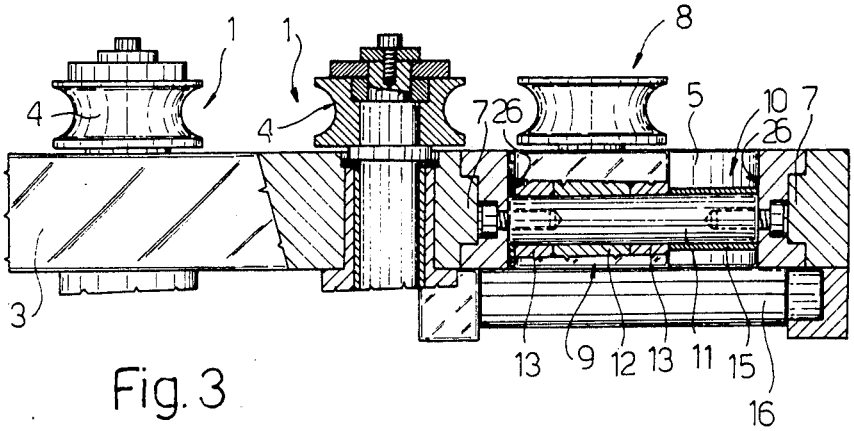
FIG. 3 shows a partially-sectioned side view of the FIG. 2 machine.

Clearly, when slide 5 is shifted one way, only one of bend rollers 8 is pressed against the pipe, whereas the other moves down in such a manner as to interfere with neither the pipe nor any other part of the machine. Such an arrangement enables the formation of bends with very tight bend radii, in that the roller exerting no bend pressure on the pipe moves down off the latter in such a position as not to interfere with the result of the machine. One operating arrangement is shown in FIG. 1.

As both blocks 9, as already stated, are designed so as to turn round respective pin 11, for setting the said blocks in a given position in relation to slide 5, provision need simply be made for spacers 15 between the blocks themselves and one or both of surfaces 26 on opening 10. If the said blocks are locked by means of appropriate spacers in a given position in relation to the said slide, the bend radius formed by the mahcine on the pipe will obviously depend solely on the position of slide 5 in relation to plate 3. Consequently, for pipe bending involving different bend radii, crosswise displacement of slide 5 need simply be controlled according to an appropriate preset routine, which may obviously be achieved using any suitable facility, such as a numerical control unit.

Mutual displacement of blocks 9 on pin 11, for adjusting the position of the said blocks in relation to surfaces 26 on opening 10, may prove useful for adapting the machine to pipes or sections of different diameters or cross sections. Testing has shown that, when working with very small diameter pipes 2, both blocks 9 sould preferably be set, during bending, on surface 26 on the feed roller 1 side, as shown in Fig.s 1 and 2. In the case of large diameter pipes, on the other hand, bending should preferably be performed with the said two blocks set closer towards or indeed against the other surface 26. The latter case provides for more even bending on account of the greater clearance between the second pair of feed rollers 1 and the actual bend roller 8. Bending a large diameter pipe on the machine set up as shown in FIGS. 1 and 2 could result in localized permanent deformation and, consequently, either an irregular or maladjusted bend radius.

Obviously, any appropriate member or device may be provided for positioning blocks 9 as required in relation to surfaces 26 on opening 10 of slide 5. For example, a screw and nut screw pair may be employed, with one part of the pair integral with blocks 9 and the other with slide 5, thus enabling manual control from outside.

The facility described clearly provides for producing semifinished parts comprising a number of zigzag sections, which may be varied continuously according to a given required routine and having, as shown, very small bend radii. to those skilled in the art it will be clear that changes may be made to the machine components as described herein without, however, departing from the scope of the present invention.

I claim:

1. A bending machine for pipes, sections or similar, comprising:

two pairs of opposed parallel feed rollers mounted on a plate between which piep is fed in a given first direction and of which the rollers of at least one of the said pairs are powered;

a slide mounted within said plate and movable in a second direction perpendicular to the first and to the axes of the said rollers;

a pair of opposed bend rollers turning on said slide in idle manner, each of the said rollers being adapted to press against and bend the pipe in a direction perpendicular to said first direction subsequent to displacement of the slide; and a lowering and clearing means coupled to said slide and plate for lowering and clearing one of said bend rollers from the path of said pipe when the other said bend roller is forced against said pipe for bending said pipe subsequent to displacement of said slide, said lowering and clearing means moving on of said rollers in a direction transverse to said first and second direction.

2. The pipe bending machine according to claim 1, in which said lowering and clearing means comprises:

a pair of turning blocks, housed inside an opening on the said slide;

a hinge for said blocks comprising a pin having its axis parallel with said first direction and being mounted on said slide in the centre plane of the same; and a fixed supporting member for said blocks, located beneath the blocks themselves and in such a position as to support one of the said blocks in a position whereby the respective roller axis is parallel with that of the said feed rollers, while at the same time enabling the other said block to move down when said slide is shifted for setting the roller on the first block against the pipe for the purpose of bending it.

3. The bending machine according to claim 1, in which said supporting member comprises a bar located beneath said slide.

4. The machine according to claim 2, in which said blocks are essentially parallellepiped, one of the same presenting a projection designed to fit between a pair of tabs on the other; provision being made in said projection and in said tabs for holes for accommodating said pin on said slide.

5. The machine according to claim 1, which further comprises a pair of turning blocks, housed inside an opening on the said slide, said opening formed on said slide is larger than said blocks, the latter moving in relation to said plate in said first given direction.

6. The machine according to claim 5, in which securing means are provided for securing said blocks in a given position as required in said first direction.

7. The bending machine according to claim 1 in which further said plate on which turn said two pairs of powered rollers is flat and an opening housing said slide is formed; the latter being guided by rails formed on said plate and being controlled by a hydraulic cylinder mounted on the plate itself.

* * * * *